US010329812B1

(12) United States Patent
Hallsten et al.

(10) Patent No.: US 10,329,812 B1
(45) Date of Patent: Jun. 25, 2019

(54) TANK COVER ACCESS HATCH WITH SAFETY BARRIER

(71) Applicant: Hallsten Corporation, Sacramento, CA (US)

(72) Inventors: Jeffrey A. Hallsten, Sacramento, CA (US); Roland Wright, Roseville, CA (US); Ronald Kuehne, Lincoln, CA (US)

(73) Assignee: Hallsten Corporation, Sacramento, CA (US)

( * ) Notice: Subject to any disclaimer, the term of this patent is extended or adjusted under 35 U.S.C. 154(b) by 0 days.

(21) Appl. No.: 15/802,158

(22) Filed: Nov. 2, 2017

(51) Int. Cl.

| | |
|---|---|
| ***E04B 1/344*** | (2006.01) |
| ***E05D 3/12*** | (2006.01) |
| ***E05D 15/24*** | (2006.01) |
| ***E06B 3/48*** | (2006.01) |
| ***E04H 4/08*** | (2006.01) |

(52) U.S. Cl.
CPC ..... *E05D 3/122* (2013.01); *E04H 4/082* (2013.01); *E05D 15/242* (2013.01); *E06B 3/486* (2013.01); *E04B 1/344* (2013.01)

(58) Field of Classification Search
CPC ..... E05D 11/0054; E05D 3/122; E05D 15/24; E05D 15/242; E04H 4/082; E04H 4/08; E04H 4/14; E04H 4/12; E06B 3/486
See application file for complete search history.

(56) References Cited

U.S. PATENT DOCUMENTS

| | | | | |
|---|---|---|---|---|
| 5,325,646 | A * | 7/1994 | Hallsten | E04B 7/08 52/246 |
| 5,617,677 | A * | 4/1997 | Hallsten | E04B 7/08 52/23 |
| 5,921,030 | A * | 7/1999 | Ducotey | E04H 4/08 52/23 |
| 5,941,027 | A | 8/1999 | Hallsten | |
| 6,012,259 | A | 1/2000 | Hallsten | |
| 6,151,835 | A | 11/2000 | Hallsten | |
| 2005/0115157 | A1 * | 6/2005 | Koga | E02D 29/14 52/3 |

* cited by examiner

*Primary Examiner* — Beth A Stephan
(74) *Attorney, Agent, or Firm* — Thomas M. Freiburger

(57) ABSTRACT

A tank cover, especially a cover on a sewage treatment tank, is provided with an access opening with a liftable hatch cover. Along with the hatch cover is a safety barrier or grate, either connected directly to the hatch cover or to structure surrounding the hatch opening. When the hatch is opened the barrier is deployed to prevent a worker from accidentally falling through the opening. In one form the barrier is pivotally attached to the bottom side of the hatch cover, and can be swung out as the hatch is opened to form an "A" shaped or roof shaped barrier, with the hatch cover and the barrier both inclined and essentially forming a roof over the opening. Braces or struts hold these components in the erected position and provide barriers from the sides. For entry of a person through the opening, the barrier or grate can be retained against the bottom of the hatch cover as the cover is swung fully open, through 180°. In another form the barrier is secured to tank cover structure just below the hatch cover and can be left in place as a horizontal barrier when the cover is fully opened. For access into the tank the barrier/grate can be swung back in the same direction as the access cover and stacked on the opened access cover.

17 Claims, 17 Drawing Sheets

HATCH CLOSED

HATCH & GRATE OPEN

HATCH CLOSED

HATCH OPEN

INSULATED PANEL

TANK COVER ACCESS HATCH WITH SAFETY BARRIER

BACKGROUND OF THE INVENTION

The invention concerns liftable hatch covers for decks or tank cover structures, especially for covers over tanks in sewage treatment plants. In particular the invention encompasses a safety barrier or grate that cooperates with the hatch cover and prevents service personnel from falling through an open hatch of such a tank cover.

Tank covers, particularly for sewage treatment tanks, are shown in U.S. Pat. Nos. 6,151,835, 6,012,259 and 5,941,027 of Hallsten Corporation. The tank covers, as well as liftable hatches for incorporation in the tank covers, are typically formed of interconnected extruded aluminum components, as shown in each of the above-listed patents.

The prior Hallsten patents, especially U.S. Pat. No. 5,941,027, show tank access hatches that hinge back a full 180° when fully opened, and this can be achieved via a special hinge, essentially a "gear hinge".

Such tank access covers, especially for sewage treatment tanks, are opened for several reasons: to enable a worker actually to enter the tank for servicing, or to extend a servicing implement into the tank; or simply to admit a flow of air into the tank for aeration, the air being drawn by a fan located elsewhere in or on the tank. The open hatches present a problem of a worker accidentally falling through the opening.

This problem of open hatches, whether over a hatch opening in a public sidewalk, a floor access hatch, or a roof access opening or skylight, has been addressed previously. For example, see the "Hatch Safety Net", marketed by Safe Approach of Poland, Me., comprising a polyester net that attaches to hook anchors on an aluminum frame that supports a hinged, solid hatch cover. The safety net can be removed from the hook anchors for access into the space below. The hatch with safety net is described as capable of being retrofitted in floor access hatches, roof scuttles, automatic fire vents or skylights. Also, USF Fabrication of Hialeah, Fla. produces a sidewalk hatch with hatch panels hinged on a frame, and one or more safety grate sections separately hinged along an edge of the frame which is perpendicular to the hinged edges of the hatch covers. The apparatus is described as "Double Safety Grate" or "Hinged Hatch Safety Grate". The hatch/grate apparatus is typically used for public sidewalk access openings.

Another safety grate product, called "RETROGRATE SERIES X", is produced by Halliday Products Inc. of Orlando, Fla. An aluminum double-door hatch cover is combined with a grate just below the doors, the grate being swingable upwardly for full access into the space below. Like the previously described product, the grate is pivoted on an axis perpendicular to the pivot axes of the hatch covers themselves.

The above safety grate devices are not directed to tank covers in sewage treatment applications, nor do they exhibit the efficient construction, operation and safety features of the invention described below.

SUMMARY OF THE INVENTION

The invention encompasses several different forms of combined hatch cover and safety grate or barrier, as applied to a tank cover particularly of a sewage treatment plant. The tank cover is formed of assembled plank, edge connector and beam components, primarily aluminum extrusions, as described in the previous Hallsten patents noted above. The access cover for the hatch can advantageously be produced from the same aluminum extrusions, especially the planks and edge connectors (interlocking deck channels).

In a first embodiment the hatch cover/grate configuration of the invention forms a "A" shape when raised to the open position with the barrier deployed.

A hatch cover, preferably with a gear hinge on one edge that allows the hatch to fold completely back onto the deck (through) 180°, has a safety grate attached to its bottom side by a grate hinge. The grate hinge pivots at the forward, free end of the hatch cover, bottom side. Thus, when the hatch cover is opened, the grate structure will hang freely down from the hatch cover, unless latched back to the cover. For access of a person down into the tank, the grate can be held or latched back against the bottom of the hatch cover, to swing the two components back against the deck, stacked together. For using the opening as an air intake vent, the grate can be spread outwardly from the hatch cover, swung about the gear hinge, to the point that the bottom edge of the grate can be engaged against the deck at the edge of the opening, at the opposite side of the opening from the hatch cover hinge. Braces or struts are included as a limiting device, similar to those employed in a step ladder, on both sides, so that an "A" shape is formed. This sets the angle of the grate and cover and allows the hatch opening to serve as a ventilation opening, for admitting air into the tank, and there can be a series of these openings set up for ventilation (one or more fans exhaust the air at points on the tank distant from the hatch openings).

With the struts extended, holding the grate at its fixed position to form an "A", the struts, the grate and the hatch cover form safety barriers around the opening at all four sides.

Thus, this form of hatch cover/grate serves the dual purpose of (a) allowing full access into the tank when needed; and (b) serving as a ventilation opening when needed, with safety barriers surrounding the hole.

In a second form of the invention the hatch cover can be essentially the same as in the first form, and the grate can also be similar. The grate has a pair of hinge legs extending upwardly (perpendicular to the grate) at its back end. When lying horizontally in the normal position of the grate, the grate will be pivotally connected to a beam or other fixed structure via the vertical legs, lying, for example, a few inches below the deck of the tank cover. The pivot point for the legs preferably is just below and inward of the opening, relative to the hatch cover hinge. Once the hatch cover is opened fully, through 180°, and folded back onto the deck, the grate will provide a protective barrier, lying horizontally across the opening, to prevent fall-through accidents. If access is needed for a person to enter the tank, the grate is simply pulled up and hinged about the pivot points of the legs, to swing the grate back, upside down and stacked against the opened hatch cover. The length of the hinge legs is such as to allow the opened safety grate to lie essentially flatly against the opened hatch cover.

A third form of safety grate arrangement is similar to the second form described above, except that the grate, again with hinge legs at one edge, is hinged at the opposite side of the opening from the hatch cover hinge. The hinge legs allow the grate to sit a selected distance below the closed hatch cover. When the hatch cover is opened, both the hatch and the grate can be fully opened to 180° so that each lies flatly on the deck, on opposed ends of the opening. Alternatively, the hatch can be opened, e.g. to a vertical position, and the grate can be opened at the opposite side of the access hole, also to a vertical position, for ventilation or to allow access into the tank. The system includes some form of hold open device for each of the hatch cover and the grate, such as foldable struts or a telescoping locking strut device, which will stow beneath the deck when the grate and the hatch cover are both closed.

This forms a pair of safety barriers, one at each side of the opening. Flexible lines, such as chains or cords, can be connected from the hatch cover to the grate, spanning across the side spaces that would otherwise be vulnerable to personnel falling into the tank. This provides a four-sided safety barrier around the access hole. If access through the hole is needed, the safety chains or cords at one side can be removed.

A variation of the above embodiment is to have the same hatch cover and grate opened into an "A" configuration, as in the first form described above. The free end of the grate can simply engage into a space at the bottom of the hatch cover, near its free end, and a latch can be provided to retain the two together at this point. A flexible line or chain can be put in place at each open side of the "A" configuration, so that the hatch opening will be protected by a barrier at all four sides.

The grate when in place on the opening can be supported on all four sides, if a typical extruded component as in Hallsten Corporation tank covers or decking is welded to or otherwise fixed to a beam tube at the lateral sides of the hatch opening. These are the sides of the opening that extend at right angles from the hatch hinge. Supporting the grate at all four sides allows the grate to be of lighter materials, for less total weight. The grate in this case could be a lifted-out grate, without hinges, or it could be hinged at one edge.

Essentially the same configuration could be used for another purpose, with a solid inner layer rather than a grate. This is essentially another piece of decking beneath the hatch cover. Such an inner layer can be repeated under all deck or tank cover sections, not only at hatch covers, for providing an insulation layer in the case of a high-temperature sewage treatment process. The system called ATAD (auto thermophilic aerobic digestion) is operated at 180° F., and must be well insulated, up to R-20 insulative value. The deck panels of the invention are essentially all lift-out panels, and the lower panels can also be liftable, so that each panel can provide access.

The hatch cover/safety grate system of the invention is of simple and lightweight construction, is highly compatible with a tank cover of extruded aluminum components, is easily operated, and is effective to prevent fall-through accidents. These and other objects, advantages and features of the invention will be apparent from the following description of a preferred embodiment, considered along with the accompanying drawings.

DESCRIPTION OF PREFERRED EMBODIMENTS

Figure 1A:
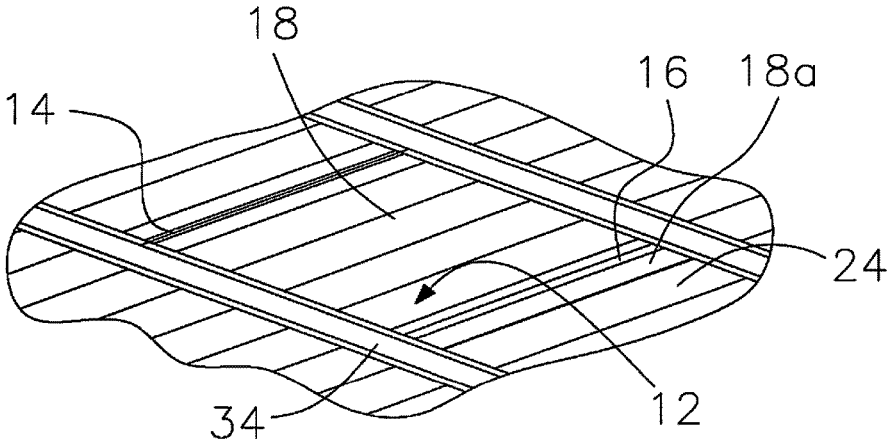
FIGS. 1A, 1B and 1C are perspective views showing a tank cover with a hatch cover of the invention, shown closed and opened.
Figure 1B:
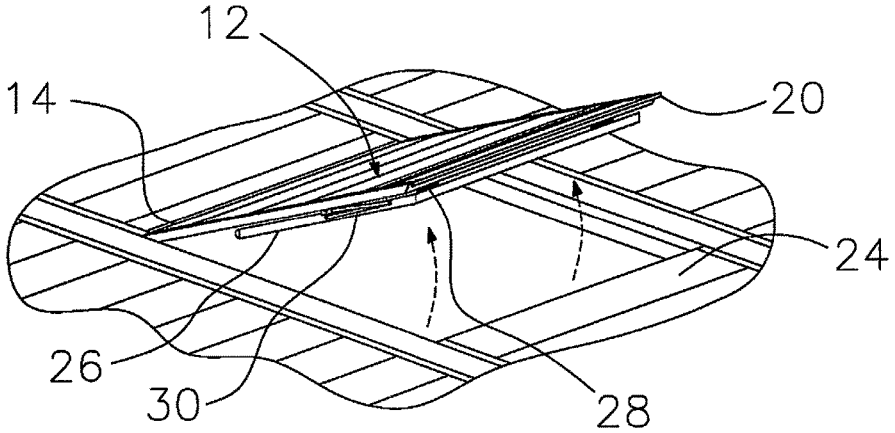
Figure 1C:
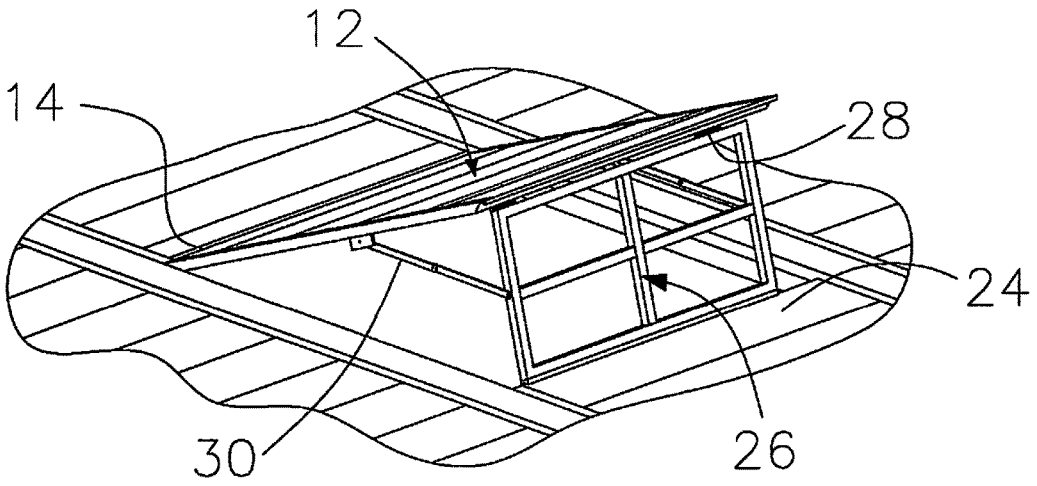

FIGS. 1A-1C show a deck or tank cover 10, formed almost entirely of interconnected aluminum extrusions, essentially as in the patents of Hallsten Corporation referenced above, as well as other Hallsten patents. The deck or tank cover includes an access opening with a hatch 12, openable via a hinge 14 which, as noted above, can be as described as in Hallsten U.S. Pat. No. 5,941,027. The hatch 12 includes a handle 16 which is incorporated in one of the extruded aluminum planks 18, 18*a* that form the hatch cover ("hatch"). As explained above, the hatch/safety barrier of the invention is advantageously used in sewage treatment tank covers.

Figure 2:
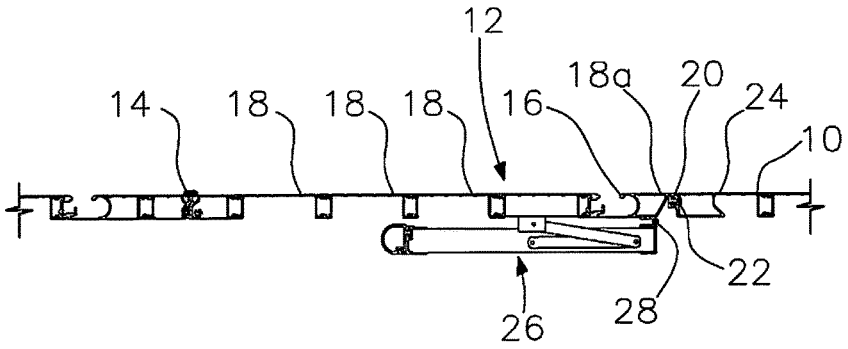
FIG. 2 is a sectional elevation view showing the hatch cover closed and showing an attached barrier or grate.

FIG. 2 shows the hatch opening closed, with the hatch cover 12 supported by the hinge 14 at the left of the drawing, and with a free end 20 formed as a lip that resides on a flange 22 which can be part of an extrusion 24 at the edge of the hatch opening, i.e. fixed structure. A barrier or grate 26 is shown suspended below the closed hatch 12. In this embodiment the grate 26 is secured by a grate hinge 28 to the outer extrusion 18*a* of the hatch cover. FIG. 2 shows the grate substantially fully engaged against the bottom of the hatch cover, and this configuration can be retained by an appropriate form of latch if desired, such as a simple hook and eye or a slide bolt (not shown).

Figure 3:
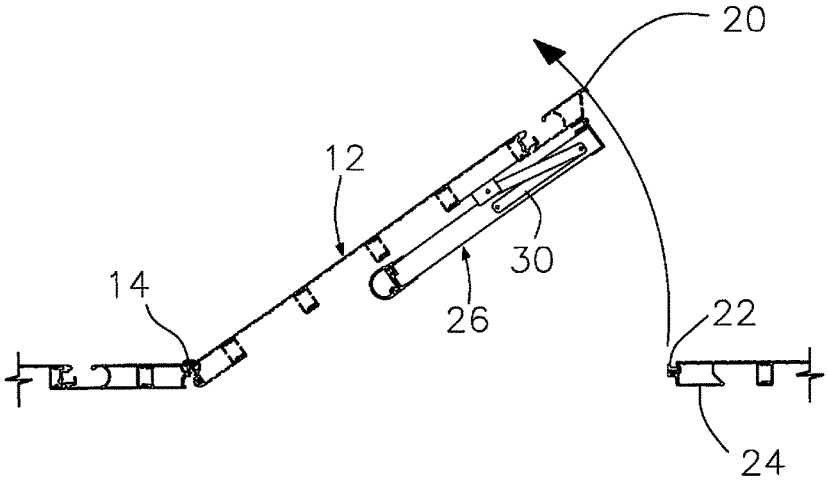
FIG. 3 is a sectional elevation view similar to FIG. 2, with the hatch cover partly opened.
Figure 4:
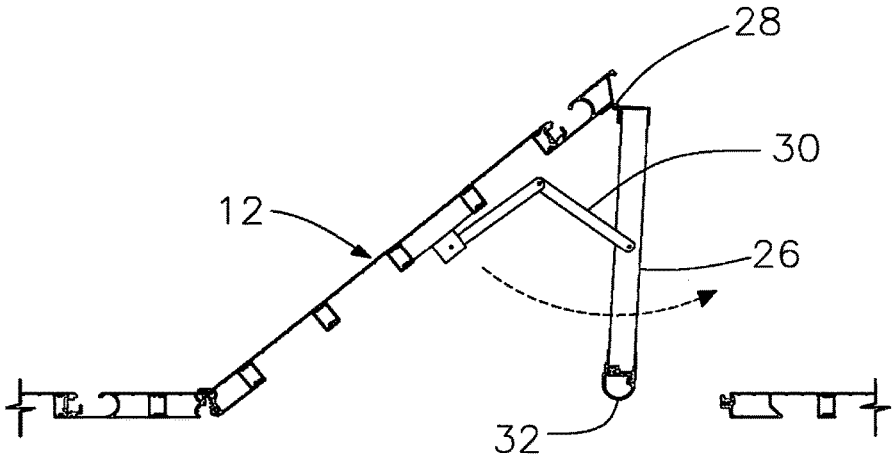
FIG. 4 is a further sectional view showing the grate being deployed.

As shown in FIG. 3, for access the hatch 12 is swung upwardly about the hinge 14, with the grate 26 retained against the bottom of the hatch cover. In FIG. 4 the cover 12 has been raised sufficiently to deploy the grate 26 as a safety barrier, spreading it outwardly via the grate hinge 28 to a fully extended position, shown in FIG. 5. As shown in these views, the pivoted brace 30 opens in the manner of a stepladder brace, fully extended in the erected position of FIG. 5. The opened brace 30 may be permitted to travel slightly over-center to form the locked position. In this configuration the assembly makes an "A" shape, the brace 30 being repeated at both sides. The grate (barrier) 26 when deployed engages its foot end against the edge of the access opening, at the extrusion 24. This is preferably via an elastomeric end piece, such as a D-seal 32 as shown.

In the example shown, the access opening has a width (as viewed in FIG. 5) of about two feet eight inches to two feet ten inches, with the hatch 12 angled upwardly at about 35° (or 25° to 45°). The length of the grate 26, i.e. the dimension shown in FIG. 5, can be about 14 inches, or about 13 inches to 18 inches. The dimensions and angles can be selected as desired, and suited to the size of the access opening.

Figure 5:
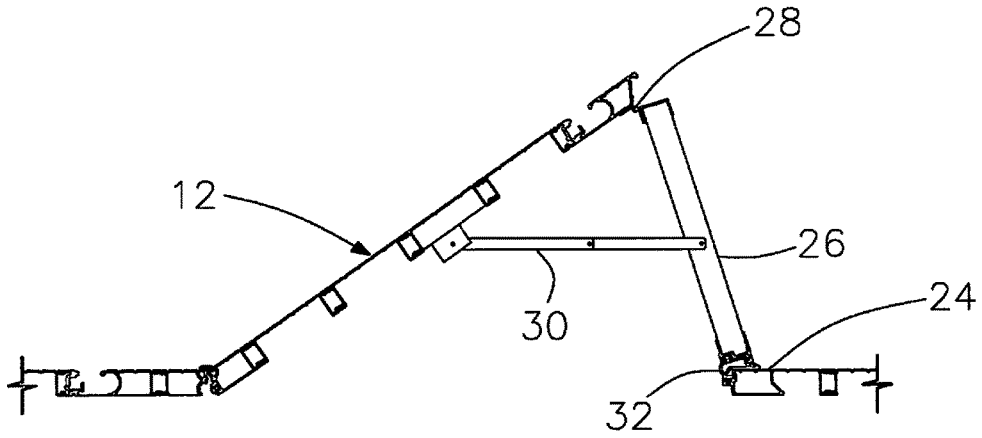
FIG. 5 is a similar sectional view showing the grate fully deployed, with the hatch cover and grate in a "A" configuration protecting the hatch opening.

With the braces 30, the structure shown in FIG. 5 provides a barrier on all sides of the access opening.

Figure 6:
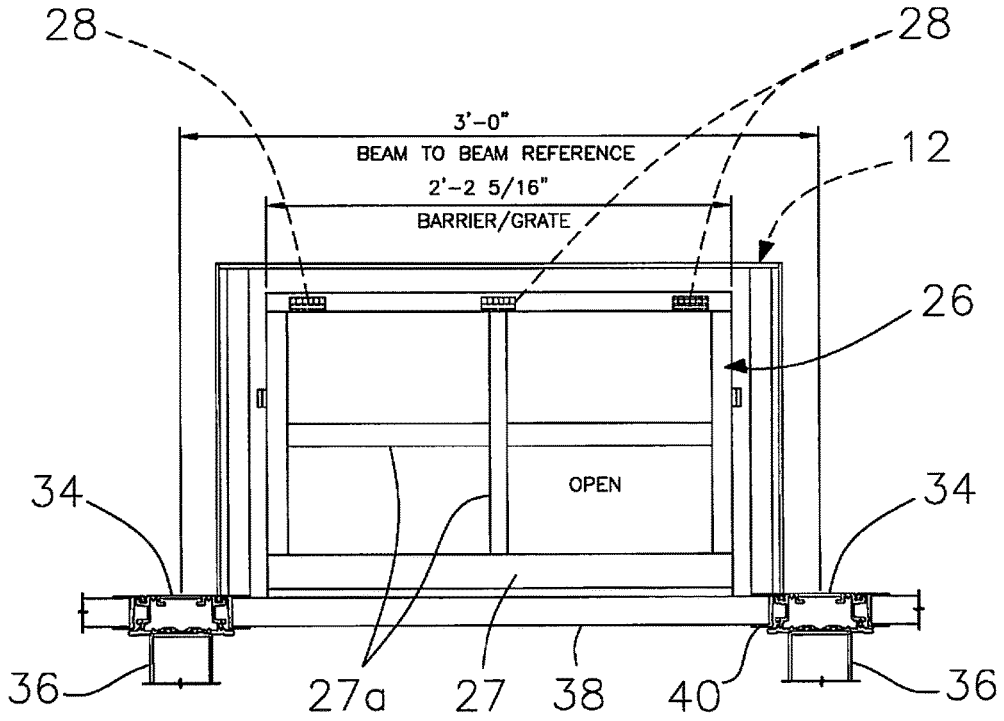
FIG. 6 is an elevational view, partially in section, showing the opened hatch and grate.

FIG. 6 is a further illustration of the erected hatch/barrier system shown in FIG. 5. This elevation view is from the right relative to FIG. 5. This view, partially in section, indicates extruded aluminum interlocking beam tubes 34 that may frame the access opening, these beam tubes 34 normally being secured to structural aluminum or steel beam tubes 36 below. The beam tubes 34 have upwardly hooked flanges at each side as shown. A deck plank 38 is seen at the far side of the opening in FIG. 6, retained at edges (as with other deck planks) by an extruded aluminum interlocking deck channel or 10 framing channel 40, which has a downwardly hooked flange to be received on the flange. The deck channel 40 also rests at its bottom side on the beam tube 34 as shown (on a lateral protrusion 34*a* of the beam tube). This is consistent with typical liftable panels of Hallsten Corporation as seen in previous Hallsten patents.

In the example shown, the spacing from beam to beam (36) can be about three feet, although the dimension can vary as desired. The grate 26 can have a width of about 24-26 inches, although this, too, can vary. In FIG. 6 the grate is seen as a preferably aluminum frame 27 supporting crossing internal pieces.

The erected configuration shown in FIG. 5 is useful when the hatch opening is to used as an aeration vent, as discussed above. When access through the opening into the tank is desired, the hatch hinge 14 (FIG. 3) allows the hatch 12 to be completely folded back onto the deck, through 180°. The grate 26, preferably latched in place, can remain against the bottom of the hatch, to be stacked on the top of the hatch when the hatch is fully opened.

Figure 7:
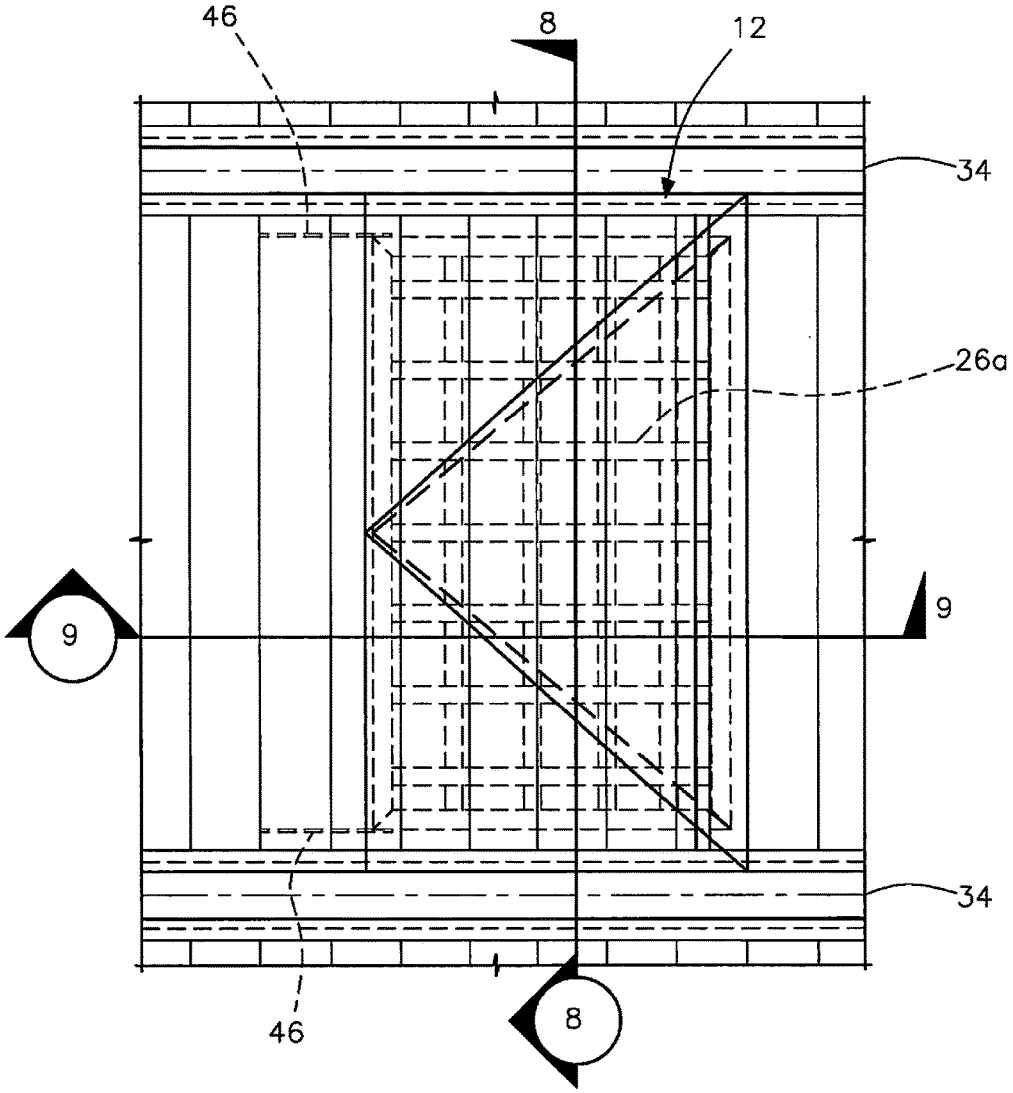
FIG. 7 is a plan view showing a closed hatch in a tank cover, in another embodiment.
Figure 8:
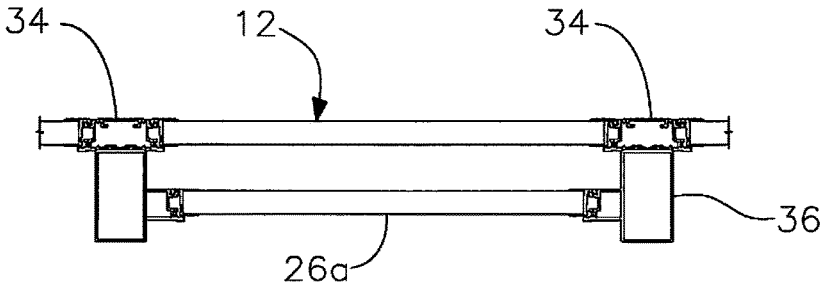
FIG. 8 is a sectional elevation view as seen along the line 8-8 in FIG. 7.
Figure 9:
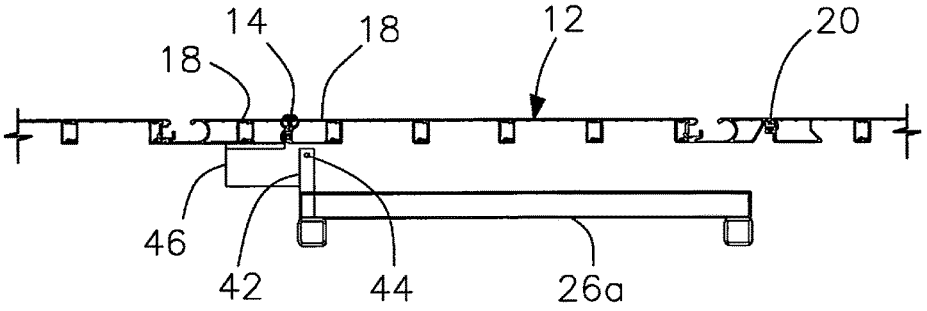
FIG. 9 is a sectional elevation view as seen along the line 9-9 in FIG. 7.

FIGS. 7 to 15 show another form of the invention. In the plan view of FIG. 7 the hatch is closed, the hatch cover being seen at 12. Interlocking beam tubes are seen at 34, at opposed non-hinge edges of the access opening. In dashed lines the grate 26*a* is indicated, just below the hatch cover 12. The sectional view of FIG. 8, a lateral view taken along the line 8-8 in FIG. 7, shows the positions of the hatch 12 and the grate 26*a*, as well as the surrounding interlocking beam tubes 34 and structural beam tubes 36. The hatch 12 rests via its side edges on structure of the interlocking deck channels 34, or structure attached thereto, in the manner shown for another panel in FIG. 6. The hatch is liftable upwardly at a hinge 14 which is not seen in FIG. 8 but is illustrated in FIG. 9. In this embodiment the grate 26*a* is supported in a different way. FIG. 9 shows that the grate has, at its back end adjacent to the hatch hinge 14, hinge legs 42 that serve to space the grate downwardly an appropriate distance. The pivot for the grate is at 44, below the hatch hinge 14 and slightly inward of the opening relative to the hinge 14. The pivot 44 is a hinge that occurs at both sides of the grate, or it could be continuous, and it is supported on fixed structure (i.e. the planks 18 of a panel to the left as seen in the drawing) by a mounting bracket 46. FIG. 9 shows the point 20 at which the free end of the hatch 12 rests on the surrounding deck structure when closed.

Figure 10:
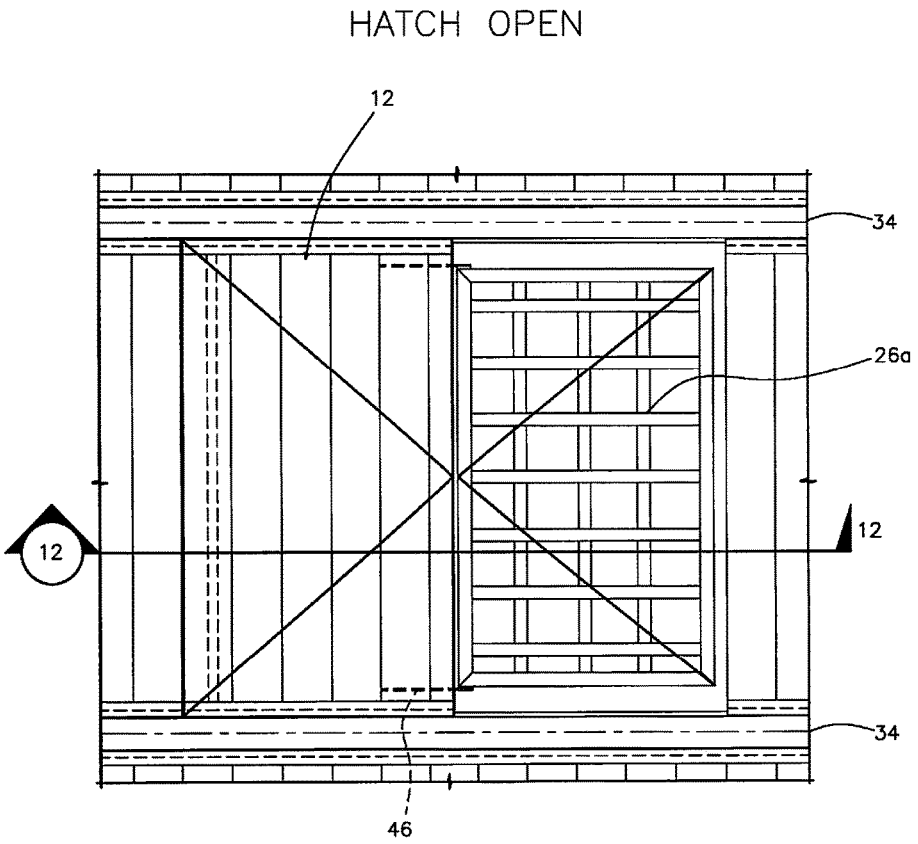
FIG. 10 is a plan view showing the hatch opened.

FIG. 10 shows the hatch assembly of this embodiment with the hatch cover 12 fully opened, folded back against the deck. The grate 26*a* protects against fall-through accidents at the opening. The brackets 46 that support the grate for pivoting are seen in dashed lines in FIG. 7.

Figure 11:
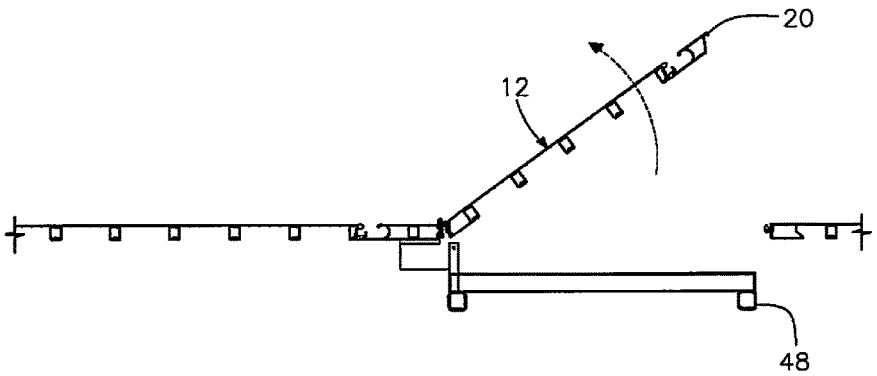
FIG. 11 is a sectional elevation view showing the hatch cover partially opened, with a barrier below.
Figure 12:
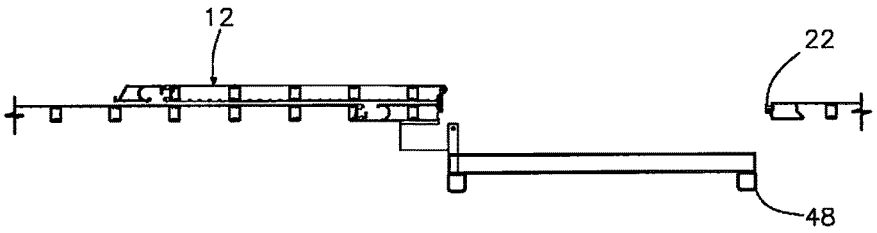
FIG. 12 is a similar elevation view showing the hatch cover fully opened and folded back onto the deck or tank cover.

The side elevation views of FIGS. 11 and 12 indicate the opening of the hatch 12 and its fully opened position. The free end of the grate, at 48, rests on fixed structure of the adjacent panel or other structure (not shown), or it can simply be supported fully along the length of the sides, as shown schematically in FIG. 8.

Figure 13:
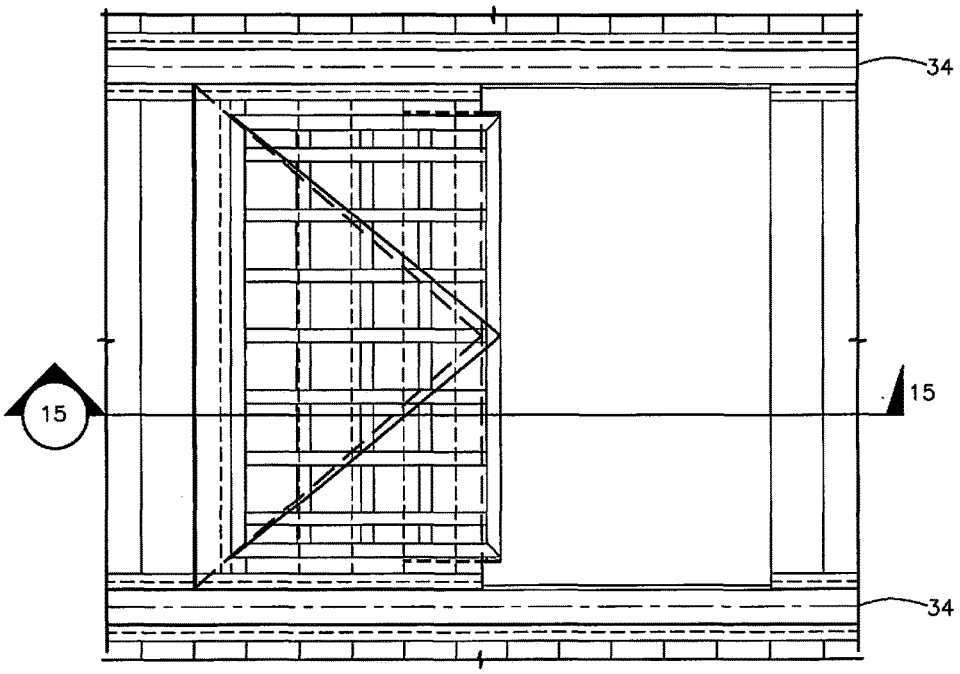
FIG. 13 is a plan view showing the barrier or grate fully opened and folded back onto the opened hatch cover.
Figure 14:
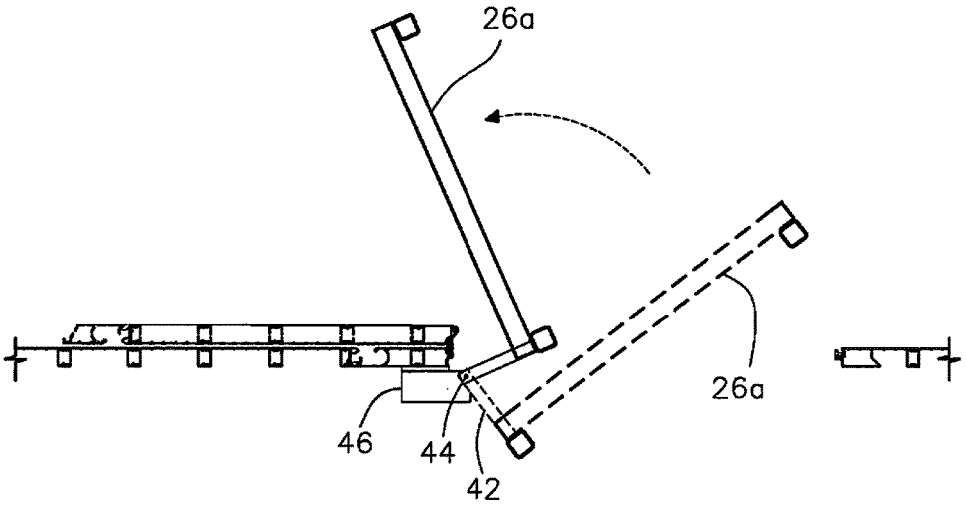
FIG. 14 is a sectional elevation view indicating opening of the grate.
Figure 15:
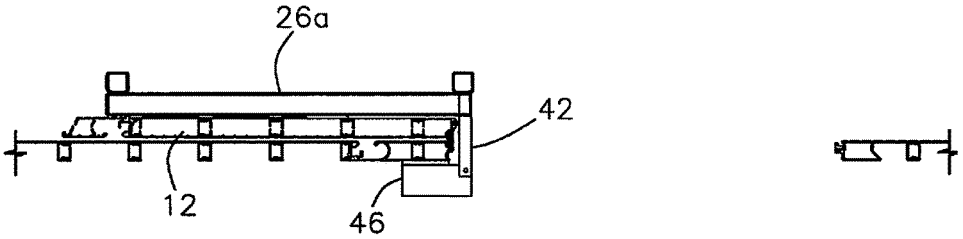
FIG. 15 is a similar sectional elevation view showing the grate fully opened and folded back, as in FIG. 13.

FIGS. 13 to 15 show opening of the grate for access of a service person into the tank. FIG. 8 shows that, as here, both the hatch and the grate preferably are fully supported along the length of both sides, via engagement of extrusions. The beam tube 36, below 34, supports fixed structure to receive the grate 26*a* (a ledge 49 is indicated schematically for support at both sides of the grate). In FIG. 14 two different positions of the grate are shown, as it is swung upwardly. FIGS. 14 and 15 show the reason for the hinge legs 42, the length of which is just enough to allow the grate 26*a* to lie flatly against the opened hatch cover 12.

Figure 16:
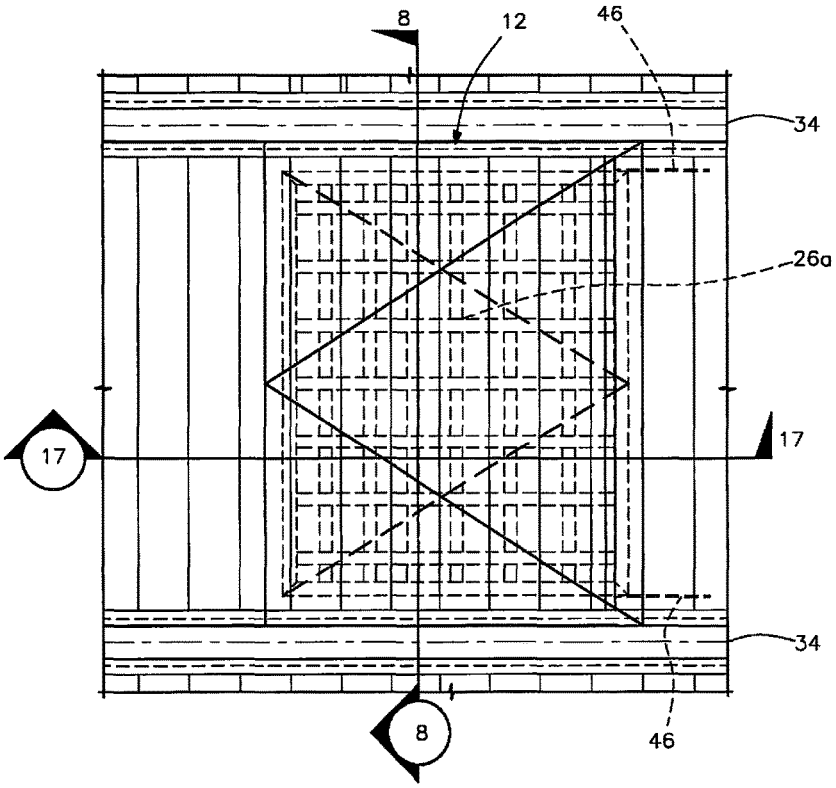
FIG. 16 is a plan view showing a further embodiment of the invention, showing the hatch cover and grate in closed position.

FIGS. 16 to 22 show another form of the hatch/grate system of the invention. FIG. 16 is a plan view, with the hatch closed and the grate 26*a* in place below. A sectional elevation view looking left would be similar to FIG. 8, in regard to position and supporting of the hatch 12 and the grate 26*b* below. Note that the apex of the triangle indicator in these plan views denotes the hinge side of the hatch.

Figure 17:
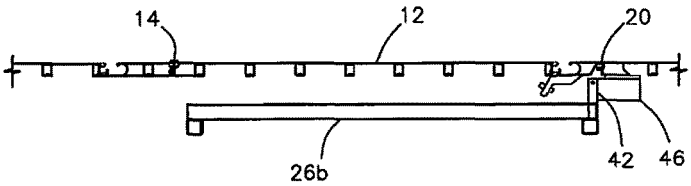
FIG. 17 is a sectional elevation view seen along the plane 17-17 in FIG. 16.

FIG. 17 is a section view looking in the plane 17-17 in FIG. 6, i.e. a side view. The hatch is at 12, with the hinge of the hatch shown at 14. The principal difference in this embodiment is that the grate 26*b* is supported at the opposite end as compared to the embodiment of FIGS. 7 to 15. The grate 26*b* has hinge legs 42, similar to those shown in FIGS. 9-15, establishing a spacing of the grate 26*b* below the deck appropriate to allow the grate to be folded back through 180°. In this case the grate will be opened in the opposite direction from that of the hatch, so that when fully opened, the two will lie at opposite ends of the access opening.

Figure 18:
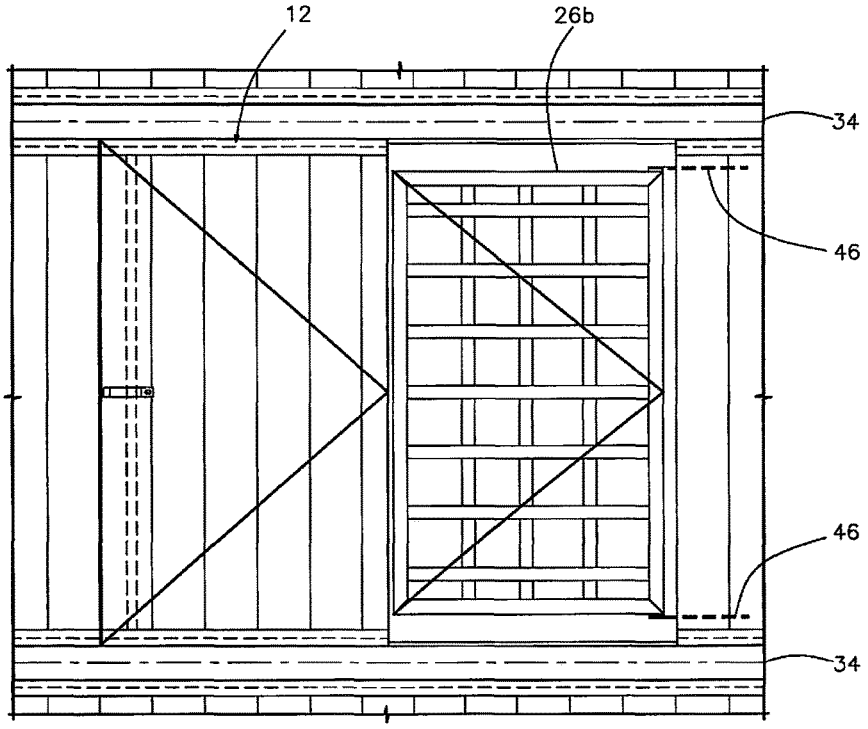
FIG. 18 is a plan view of the system shown in FIGS. 16 and 17, with the hatch cover opened and folded back onto the deck, and showing the barrier/grate in place over the opening.

FIG. 18 shows the hatch both fully opened, lying on the deck at the left side of the access opening as seen in this plan view. The barrier or grate 26*b* is in place, for protection against fall-through accidents. The pivot or hinge support of the grate is indicated at 46, and is similar to that shown in FIGS. 11-15, although at the opposite end of the opening. Side support for the grate, at both lateral sides, is not shown but preferred.

Figure 19:
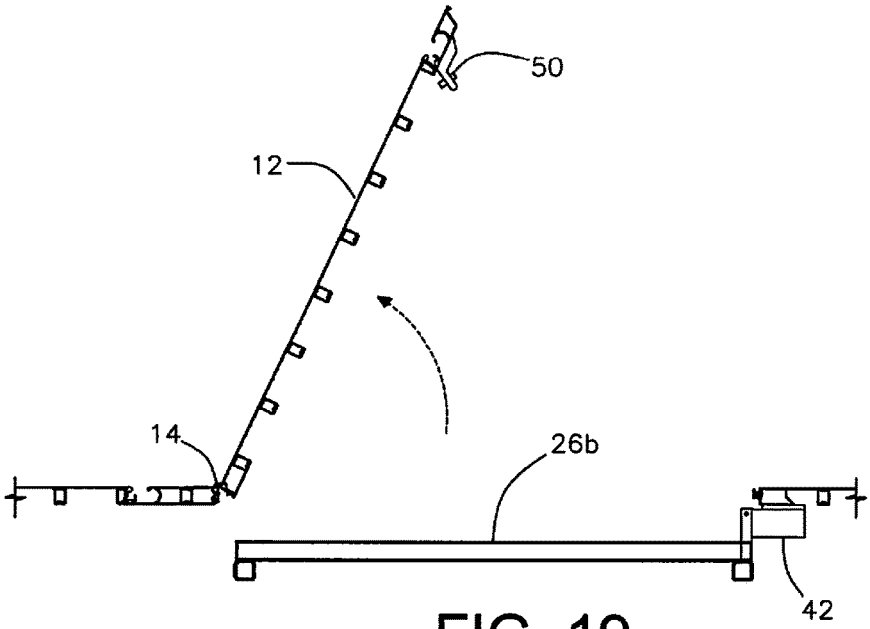
FIG. 19 is a sectional elevation view showing the hatch cover being opened.
Figure 20:
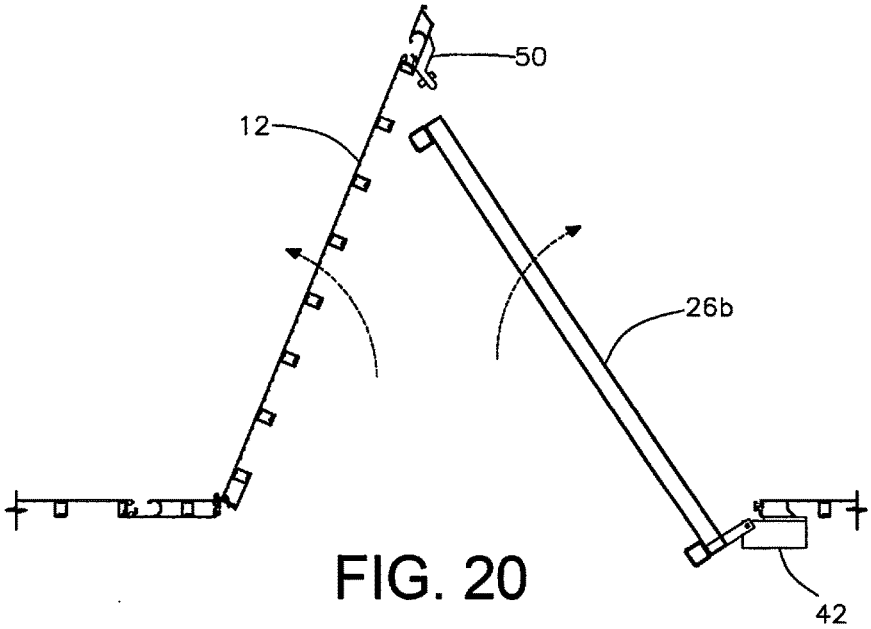
FIG. 20 is a similar sectional view showing the hatch cover partially opened and the barrier being moved to the open position.
Figure 21:
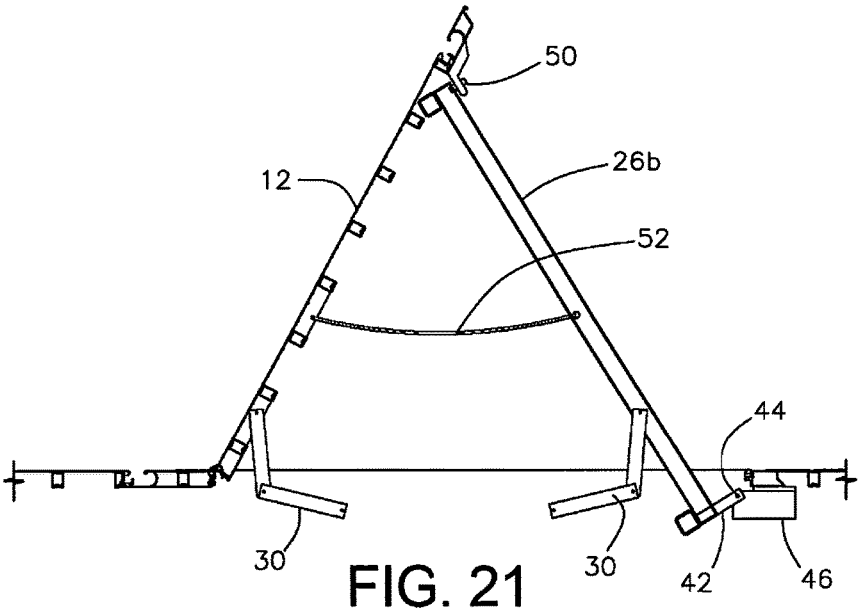
FIG. 21 is a similar sectional view showing the hatch cover and barrier, hinged at opposite sides of the opening, fully erected into an "A" configuration.

The position shown in FIG. 18 is appropriate for using the opening as an air intake, as discussed above. The components can assume different positions, as well, for use as an air intake. FIG. 19 illustrates the swinging up of the hatch cover 12, and FIG. 20 shows the upward deployment of the grate, as the hatch 12 is held in position. Once the components reach the position shown in FIG. 20, they can be secured together as in FIG. 21, in the "A" configuration. For this purpose a bracket 50 is included on the bottom side of the hatch, near its outer end. This can have pins that couple with structure or openings in the grate, to retain the erected configuration shown in FIG. 21. Also, chains or flexible lines can be included, one at each side of the erected hatch/grate assembly, to provide a form of safety barrier at all four sides, in conformity with safety requirements.

As noted above, if access through the opening is needed, the hatch 12 and the grate 26*b* can each be fully swung to 180°, to rest against the deck. The hinge legs 42 at the hinged end of the grate have length selected for this purpose.

Figure 22:
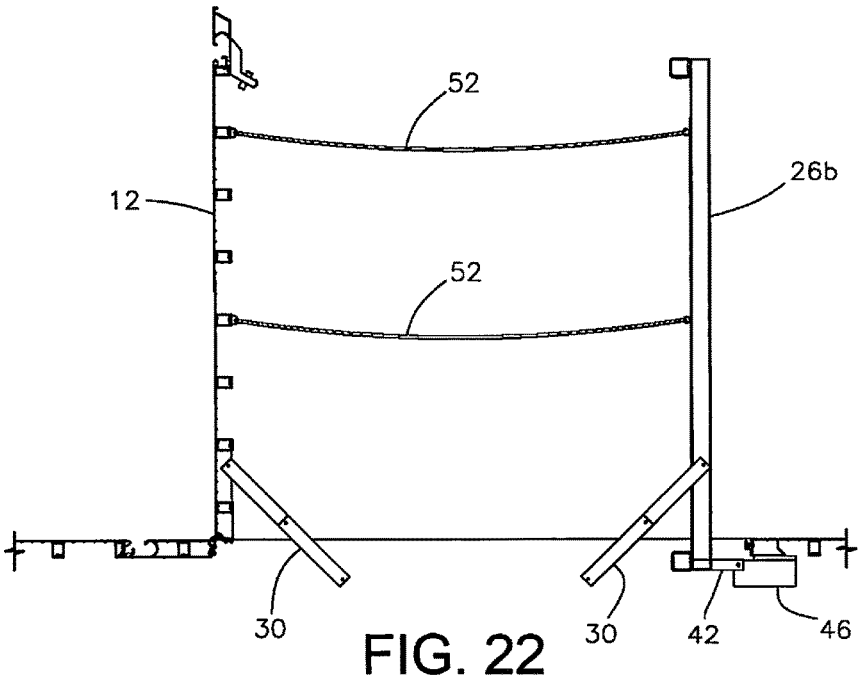
FIG. 22 is a similar sectional view but showing the hatch barrier both opened to and retained in vertical orientations.

FIG. 22 shows an alternate erected configuration for the hatch 12 and grate 26*b* of FIGS. 16-21. In this case each is set to a vertical configuration, with pivot braces 30 provided at each side of each of the hatch and grate, as schematically shown in the drawing. The lower ends of these foldable braces can be secured to the interlocking beam tube 34 or structural beam tube 36, or to structure supported by those members.

In FIG. 22 pairs of chains or cables 52 are shown at upper and lower locations, extending between the hatch cover 12 and the grate 26*b*, to provide a four-sided safety closure around the opening. The height of the upper cable 52 is such as to meet safety handrail requirements.

As explained above, the assembly shown in FIGS. 16 to 22 can be modified for a special purpose, such as for ATAD, a sewage treatment system operated at high temperature, e.g. about 180° F. Lower support plates can be placed in a position of the horizontal grate 26*b*, potentially capable of lifting out, but preferably not pivoted. These can provide a means for insulating the space between the deck panels and the barrier plate, and this can occur at every panel of a deck or tank cover.

Figure 23:
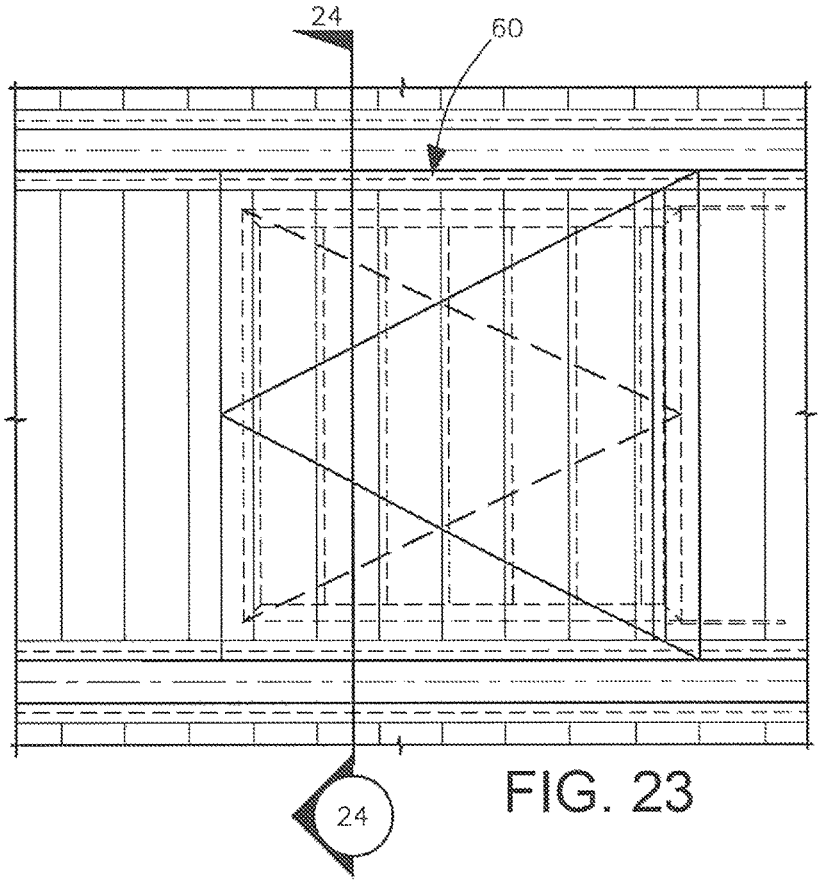
FIG. 23 is a plan view showing a portion of a tank cover and liftable panel in another embodiment of the invention.
Figure 24:
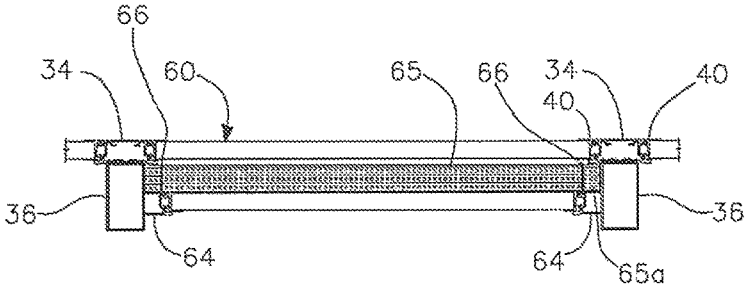
FIG. 24 is a sectional elevation view of the embodiment shown in FIG. 23.

FIGS. 23 and 24 illustrate one implementation of such a system for insulation. In FIG. 23 a liftable panel 60 is shown, broken away at ends (left and right in the drawing) and of any desired length. No hinges are shown in the drawing; the panel 60 could be hinged at one end, or simply configured as a lift-out panel. As in the other embodiments, interlocking beam tubes 34 support panels typically at both sides of the beam tube, with the beam tubes 34 in turn supported by structural (preferably aluminum) beam tubes 36. The panel is not affixed to the interlocking beam tubes 34, but rests on extruded flanges as explained above and as typical of tank covers of Hallsten Corporation. Note that this detail can be typical for all panels in a tank cover.

Beneath the lift-out panel 60 is a lower support plate or solid inner layer 62 which is analogous in some respects to the safety grate discussed above. The support plate 62 can also be formed of aluminum planks and interlocking deck channels at edges of the series of planks, and it can rest on brackets 64 secured to the structural beam tubes 36, as illustrated. It is thus supported at sides in the same manner as shown in FIG. 8 for the illustrated grate discussed above. A section of rigid insulation is shown at 65, supported on the removable support plate 62. To allow for the insulation section to be installed and removed as needed, it has edges that terminate at a gap 66, thus being of less width than the opening formed when the lift-out panel or hatch 60 is removed. Small end pieces 65*a* can be located to fully extend the insulation to the beams 36, resting on the structure 64 at both sides.

As explained earlier, such insulation can be installed to provide an insulative value up to R-20, for a high-temperature sewage treatment process. In this way, the illustrated assembly allows for full access into the tank by removal of the lift-out panel or hatch 60, then the insulation section 65, and finally the support plate or solid inner layer 62. When all are in place and installed, the solid inner layer 62 provides an air space below the liftable cover panel 60 which provides a small degree of thermal barrier. The insulation 65 and 65*a* fills essentially all this space, to result in an effective insulative barrier for the high-temperature process.

Figure 25:
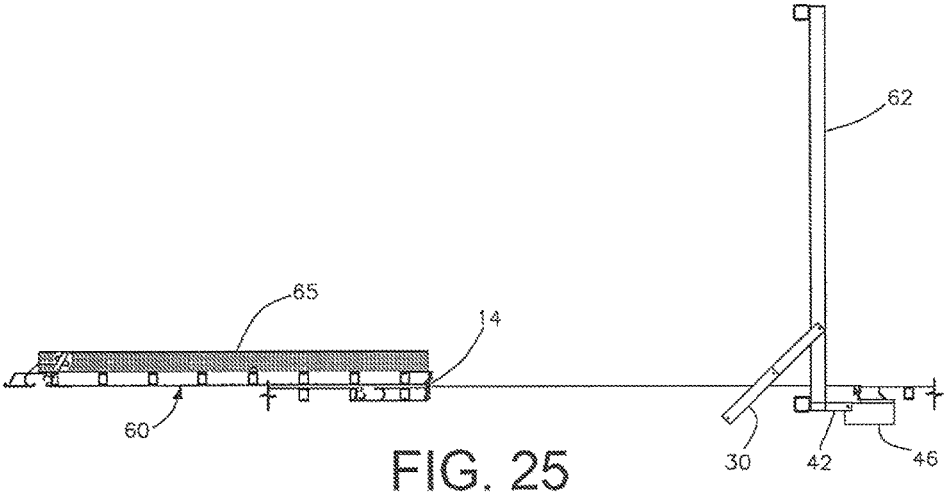
FIG. 25 is a cross-section elevation view, showing a variation.

FIG. 25 shows the system of FIGS. 23-24 but with both the deck panel 60 and the lower plate 62 being hinged, as in some of the hatch arrangements discussed above. In the elevational section views of FIGS. 25-26, seen in the direction perpendicular to that of FIG. 24, the system functions as a hatch opening with cover, but in this case the lower hinged element 62 is not a safety grate but an essentially impermeable lower plate or panel. A two-arm brace 30 can be included, as explained above, to hold the lower plate 62 in an opened position, and a hinge leg 42 is included so that the plate 62 could be folded all the way back, at 180°, if desired. In this case the insulation panel 65 is secured to the liftable deck panel 60, and remains with the deck panel when it is swung open about its hinge 14 to the folded-back position as shown in FIG. 25. This provides access through the opening.

Figure 26:
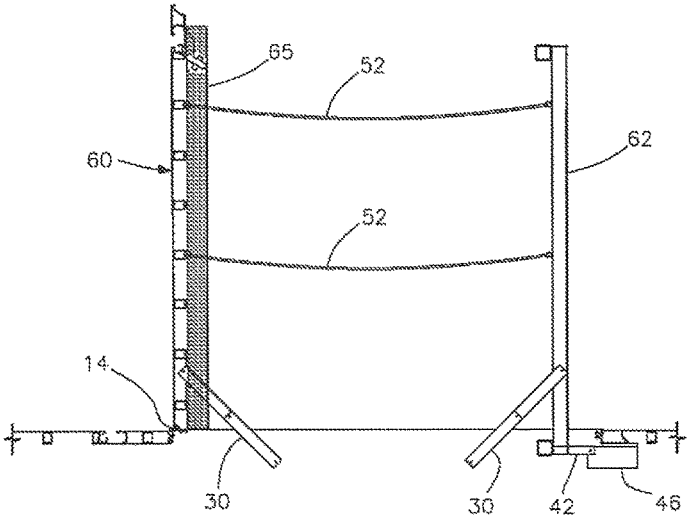
FIG. 26 is a sectional view showing components of FIG. 25 in another configuration.

FIG. 26 shows a deck or tank cover opening with the same components as in FIG. 25, but with both the hinged deck panel 65 and the solid barrier 62 opened to vertical position, again to allow access into the tank. This is essentially the same as in FIG. 22 described above, with foldable braces 30 for each of the components 65 and 62, but with the insulation panel 65 attached to the underside of the deck panel 60. As in FIG. 22, safety lines or chains 52 are shown secured between the deck panel and the lower plate 62, for safety requirements. These can be released at one side for access.

The assemblies described above are simple in construction and efficiently operated to provide, in main embodiments, safety barriers at tank cover access openings. The barrier or grate is in place for any situation wherein the access opening is to be left open for a period of time, and this can include use of the openings for admission of air for aeration or ventilation of the treatment process in the tank. The system of simple and interconnectable components is more efficient than the previously described safety barriers.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. In combination, a tank cover or deck covering a tank and assembled of a series of panels comprised of extruded parallel interconnected deck planks, with framing channel extrusions engaging ends of the deck planks to support the deck planks and hold each of the panels together, and the panels being connected at edges and supported on structural beams, and the tank cover or deck having an access opening, and a hatch assembly for covering the opening, the hatch assembly comprising:

a hatch formed of said extruded parallel interconnected deck planks connected together as a movable panel, the hatch having a top side and a bottom side and a hinge at one end, the hinge being connected to an adjacent one of the series of panels of the tank cover and being openable by swinging the hatch upwardly about the hinge, a safety grate secured to the bottom side of the hatch by a grate hinge at a free end of the hatch opposite said one end, such that when the hatch is lifted and swung about its hinge, the grate can be pivoted about the grate hinge to swing the grate away from the hatch, the safety grate when hanging from the hatch having a lower end adapted to be engaged with an edge of an adjacent structure of the tank cover adjacent to the access opening, at a position opposed from the hatch hinge, such that the hatch and grate are formed into an inverted V configuration, whereby, in addition to being erectable into said inverted V configuration, for use as a vent opening for the tank, the hatch and grate can be retained together as the hatch is opened so that the hatch lies open against the deck, with the grate on top of the hatch, allowing access of a person into the tank.

2. The combination defined in claim 1, further including a limiting device extending between the hatch and the grate to define an opened position of the grate relative to the hatch such that the hatch, grate and limiting device generally form an A shape when the lower end of the grate is engaged with said adjacent structure of the tank cover, so that the erected hatch and grate are protected at sides by the limiting device.

3. The combination defined in claim 2, wherein the limiting device comprises a pivoted brace formed of two sections, each of which has an end secured respectively to the hatch or the grate.

4. The combination defined in claim 1, wherein the grate has, at said lower end of the grate, an elastomeric cushioning piece to engage against said adjacent structure.

5. The combination defined in claim 1, wherein the grate comprises an aluminum structure with a frame and crossed components supported in the frame, defining openings sufficiently small to prevent a person from falling through the grate.

6. The combination defined in claim 1, wherein the tank is a sewage treatment tank.

7. The combination defined in claim 1, wherein the hatch is made up of said extruded parallel interconnected deck planks retained together at ends by said framing channel extrusions perpendicular to the deck planks and such that the hatch when closed is flush with all adjacent panels of said series of panels of the tank cover or deck.

8. The combination defined in claim 7, wherein the hinge at one end of the hatch comprises a gear hinge which allows a full 180° rotation of the hatch to lie flatly against an adjacent panel of said series of panels.

9. The combination defined in claim 1, with the hatch opened and the hatch and grate erected into said inverted V configuration.

10. The combination defined in claim 1, with the hatch opened and rotated through essentially 180° to lie against the deck, with the grate lying flatly on top of the hatch.

11. In combination, a tank cover covering a tank and assembled of a series of panels comprised of extruded parallel interconnected deck planks, with framing channel extrusions engaging ends of the deck planks to support the deck planks and hold each of the panels together, and the panels being connected at edges and supported on structural beams, and the tank cover having an access opening, and a hatch assembly for covering the opening, the hatch assembly comprising:

a hatch formed of said extruded parallel interconnected deck planks connected together as a movable panel, the hatch having a hinge at one end, the hinge being connected to an adjacent panel of said series of panels of the tank cover and being openable by swinging the hatch upwardly about the hinge, a safety grate secured to the tank cover below the hatch when closed, with a grate hinge securing the grate to a fixed structure of the tank cover adjacent to the access opening, the grate including hinge legs extending upwardly from the grate such that the grate pivots upwardly through the access opening about a pivot axis spaced upwardly from the lowered, closed position of the grate, and the hinge legs being of such length as to allow the grate to be swung upwardly and fully out of the access opening to be folded down horizontally.

12. The combination defined in claim 11, wherein the grate hinge is located on a side of the access opening where the hatch hinge is located, whereby, when the hatch is fully opened and laid against the tank cover and the safety grate is then opened fully to 180°, the safety grate lies directly on top of the opened hatch.

13. The combination defined in claim 11, wherein the grate hinge is located on an opposite side of the access opening from the hatch hinge, whereby when the grate is raised and pivoted above its pivot axis and fully opened the grate lies on the tank cover.

14. The combination defined in claim 11, wherein the hatch is made up of said extruded parallel interconnected deck planks retained together at ends by said framing channel extrusions perpendicular to the deck planks, as in the series of panels of the tank cover, and such that the hatch when closed is flush with all adjacent panels of said series of panels of the tank cover.

15. The combination defined in claim 11, wherein the hinge at one end of the hatch comprises a gear hinge which allows a full 180° rotation of the hatch to lie flatly against an adjacent panel of said series of panels.

16. The combination defined in claim 12, with the hatch fully opened and laid against the tank cover and the safety grate opened fully to 180° such that the safety grate lies directly on top of the opened hatch.

17. The combination defined in claim 13, with the hatch and grate both raised and pivoted to essentially vertical positions, and with flexible lines extending between the opened hatch and grate at both sides of the access opening, so that safety barriers are provided at all four sides around the opening.

* * * * *